United States Patent [19]

Pearlman et al.

[11] 4,238,787

[45] Dec. 9, 1980

[54] ELECTRONIC SIREN AMPLIFIER

[75] Inventors: Barry Pearlman, Maryland Heights; W. Kenneth Menke, Glendale, both of Mo.

[73] Assignee: Public Safety Equipment, Inc., St. Louis, Mo.

[21] Appl. No.: 71,708

[22] Filed: Aug. 31, 1979

[51] Int. Cl.[3] ..... G08B 3/00

[52] U.S. Cl. ..... 340/384 E; 340/405

[58] Field of Search ..... 340/384 E, 384 R, 405; 330/276

[56] References Cited

U.S. PATENT DOCUMENTS

| | | | |
|---|---|---|---|
| 2,930,985 | 3/1960 | Basharrah | 330/15 |
| 3,438,028 | 5/1969 | Stewart | 340/384 R |
| 3,504,364 | 3/1970 | Abel | 340/384 R |
| 3,747,092 | 7/1973 | Smith | 340/384 E |
| 3,810,169 | 5/1974 | Locke | 340/384 R |

*Primary Examiner*—Harold I. Pitts

*Attorney, Agent, or Firm*—Senniger, Powers, Leavitt and Roedel

[57] ABSTRACT

An amplifier particularly suited for amplifying relatively low voltage level siren tone signals in an electronic siren. The amplifier includes an output transformer having first and second primary windings and having a secondary winding for connection to a loudspeaker. Each primary winding is connected during operation between a voltage source and ground and each includes first and second winding sections. Also included are first and second switching devices disposed between the winding sections of the first and second primary windings respectively for opening and closing the circuit between the winding sections of each primary winding in response to the signals which are to be amplified. Circuitry is provided for biasing each output transistor hard off when the other output transistor is conducting. Additional circuitry is provided to enable the amplifier to operate class AB to amplify speech signals.

19 Claims, 3 Drawing Figures

ELECTRONIC SIREN AMPLIFIER

BACKGROUND OF THE INVENTION

This invention relates to amplifiers and more particularly to compact amplifiers for use in automotive vehicles and other places where the limited amount of space and power available is an important consideration.

Emergency vehicles such as police cars, ambulances and the like require sirens that occupy a small amount of space but have a volume sufficient to be heard above normal ambient sound levels. Of course the amount of space available in any automotive vehicle is limited, as is the power available to run the siren. Numerous electronic sirens have been designed to meet these constraints, but generally they, and particularly their amplifiers, suffer from a variety of problems. Many units use a toroidal output transformer in the amplifier to obtain the desired efficiency, since toroidal transformers are inherently more efficient than other types of transformers. But toroidal transformers are expensive, particularly when compared with E/I lamination transformers. Moreover, toroidal transformers generally require output transistors that are beta-matched, which further increases the expense of the unit. Because of the limited space available, heat generation and heat dissipation are also significant problems in present units. In general, presently available units suffer from either high parts count or high heat dissipation or both in the amplifier. The first causes added expense while the second degrades the unit's performance.

SUMMARY OF THE INVENTION

Among the several objects of this invention may be noted the provision of an amplifier particularly suited for use in an electronic siren which is compact; the provision of such an amplifier which requires little power; the provision of such an amplifier which has an efficiency approaching or equal to that of units using toroidal transformers; the provision of such apparatus which can efficiently use an E/I lamination transformer; the provision of such an amplifier which does not require beta-matched output transistors; the provision of such an amplifier which has a minimal number of parts; the provision of such an amplifier which minimizes power and heat losses; and the provision of such an amplifier which is inexpensive in construction and reliable in operation.

Briefly, in a first embodiment an amplifier of this invention includes an output transformer having first and second primary windings and having a secondary winding for connection to a loudspeaker. Each primary winding is connected during operation between a voltage source and ground and includes first and second winding sections. Means are disposed between the first and second winding sections of each primary winding for opening and closing the circuit between the first and second winding sections in response to signals from a siren tone signal generator. As a result, currents corresponding to the siren tone signals flow through the primary windings causing the loudspeaker to acoustically broadcast the siren tone.

In a second embodiment, the amplifier includes first and second high current gain devices for amplifying first and second complementary siren tone signals, and an output transformer having first and second primary windings and a secondary winding for connection to a loudspeaker. Each primary winding is connected during operation between a voltage source and ground and includes first and second winding sections. First and second switching devices are interposed between the first and second winding sections of the first and second primary windings respectively for opening and closing the circuit between the winding sections of their associated primary windings in response to the amplified first and second complementary siren tone signals respectively, whereby currents corresponding to the siren tone signals flow through the primary windings causing the loudspeaker to acoustically broadcast the siren tone.

In a third embodiment, the amplifier of this invention includes an output transformer having first and second primary windings and having a secondary winding for connection to a loudspeaker. Each primary winding is connected during operation between a voltage source and ground and each includes first and second winding sections. First and second output transistors are disposed between the first and second winding sections of the first and second primary windings respectively for opening and closing the circuit between the winding sections of their associated primary windings in response to siren tone signals. The amplifier also includes voice/audio amplifying means for amplifying speech signals and the like and for supplying the amplified speech signals and the like to the bases of the first and second output transistors.

In a fourth embodiment, the amplifier of this invention includes a first amplification stage, a pair of output transistors operatively connected to the first amplification stage, and an output transformer having first and second primary windings and having a secondary winding for connection to a loudspeaker. The primary windings each have first and second winding sections. One of the output transistors has its collector/emitter circuit connected in series between the winding sections of the first primary winding. The other output transistor has its collector/emitter circuit connected in series between the winding sections of the second primary winding. Each primary winding is connected during operation between a voltage source and ground, whereby the conducting of one of the output transistors causes current to flow in its associated primary winding.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENT

Figure 1:
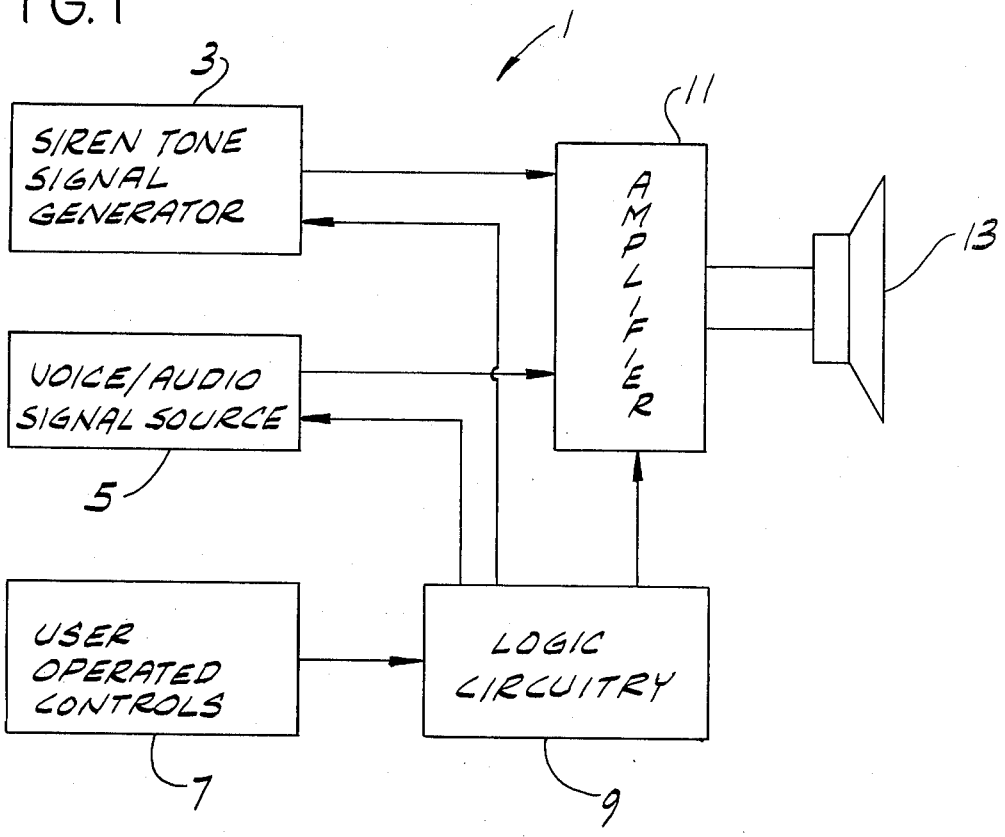
FIG. 1 is a block-diagrammatic representation of an electronic siren using the amplifier of the present invention.

Turning now to the drawings, there is shown in FIG. 1 a simplified block diagram of an electronic siren 1 suitable for mounting in an automobile or the like. The siren includes circuitry, indicated by block 3, for generating various siren tone signals at relatively low voltage levels (e.g., 5 VDC), a source indicated by block 5 of voice/audio signals (such as public address microphone or radio rebroadcast), user operated controls 7 by means of which the user can select among the various siren and voice/audio signals, the various siren and voice/audio signals, logic circuitry 9 for governing the operation of siren 1 under command of the user-operated controls, an output amplifier 11 for amplifying the siren and voice/audio input signals, as selected by the user, with high efficiency and low heat generation, and one or more speakers 13 for converting the electric output signals of amplifier 11 into the corresponding acoustical waveforms. The siren tone signal generating circuitry, the voice/audio signal source, the user operated controls, the logic circuitry and the speaker are not part of the present invention and therefore are shown only in block-diagram form.

Figure 2:
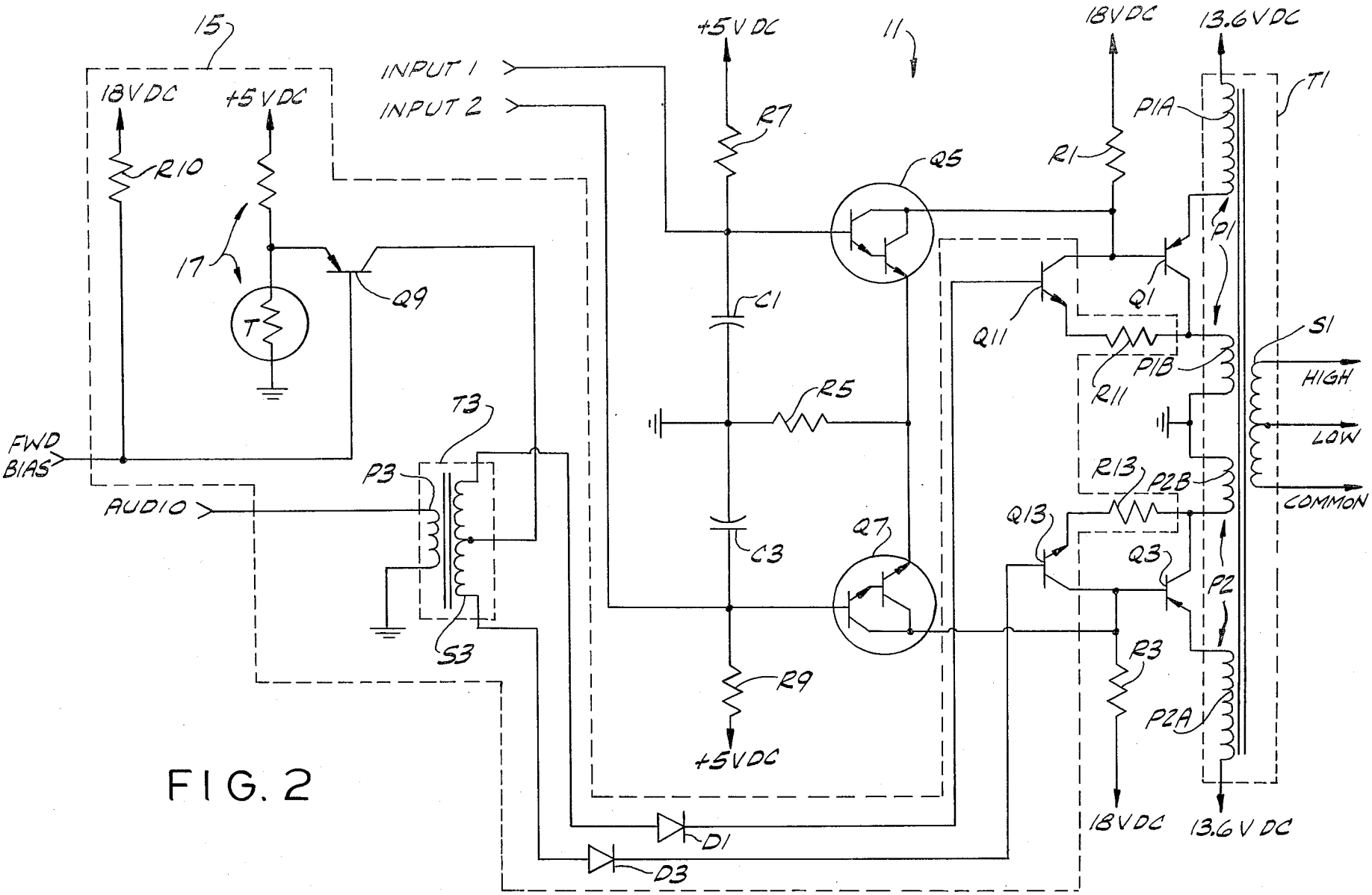
FIG. 2 is a schematic circuit diagram of the amplifier of the present invention.

Output amplifier 11, the subject of the present invention, is shown in detail in FIG. 2. Amplifier 11 comprises an output transformer T1, a pair of PNP output transistors Q1 and Q3, a pair of Darlington-configured transistors (hereinafter, Darlingtons) or similar high current-gain devices Q5 and Q7 which together constitute a first amplification stage, and a voice/audio pre-amplifying section 15. Transformer T1 includes a tapped secondary winding S1 and first and second primary windings P1 and P2, each primary winding being split into first and second winding sections P1A, P1B and P2A, P2B respectively. If speaker 13 is a high power speaker (e.g., 100 watts) it is connected to the Common side of secondary winding S1 and to the tap labelled High, which tap is selected to match the impedance of the high power loudspeaker. But when a low power speaker 13 (e.g., 58 watts) is used, the speaker is connected to the common side of winding S1 and to the tap indicated by the label Low, which tap is selected to match the impedance of the low power loudspeaker.

The emitters of output transistors Q1 and Q3 are connected to winding sections P1A and P2A respectively and their collectors are connected to sections P1B and P2B. That is, the emitter-collector circuit of each output transistor is directly connected between the two winding sections of its respective primary winding. One end of each primary winding, specifically the end of P1A and P2A not directly connected to the emitter of its respective output transistor, is connected through a switch or the like (not shown) to a supply voltage of, e.g., 13.6 VDC, which voltage is typically obtained from the positive battery terminal of the vehicle in which the siren is mounted. The other end of each primary winding (i.e., the end of sections P1B and P2B not directly connected to the collector of its respective output transistor) is connected directly to ground, or to the negative terminal when the amplifier is installed in a vehicle having a positive ground system.

The base of each output transistor is connected to the collector of one of the Darlingtons, the base of transistor Q1 being connected to the collector of Darlington Q5 and the base of transistor Q3 being connected to the collector of Darlington Q7. Each base is also connected through a resistor R1, R3 of, e.g., 10 K, to a bias voltage having a typical voltage of 18–25 VDC. The emitter of each Darlington is connected through a resistor R5 of, e.g., 0.39 ohms, to ground, while the base of each is connected to one of a pair of complementary siren inputs INPUT 1 and INPUT 2. The base of each Darlington is also connected, through a resistor R7 or R9 respectively of, e.g., 1K, to a pull-up voltage of, e.g., 5 VDC. Optionally, a pair of wave-shaping capacitors C1 and C3 (having a typical capacitance of, e.g., 0.05 micro-F) are also connected between the bases of the Darlingtons and ground.

Voice/audio pre-amplifying section 15 includes a transformer T3, a resistor/thermistor temperature compensating network 17, a pull-up resistor R10, a PNP transistor Q9, a pair of diodes D1 and D3, a pair of resistors R11 and R13, and a pair of NPN transistors Q11 and Q13. Transistor Q11 is associated with output transistor Q1 and transistor Q13 is associated with output transistor Q3. Specifically, the collector of each of transistors Q11 and Q13 is connected to the base of its associated output transistor and the emitter of each is connected through a resistor (R11 and R13 respectively) of, e.g., 10 ohms, to the collector of its associated output transistor. The bases of transistors Q11 and Q13 are connected through diodes D1 and D3 respectively to opposite sides of the secondary winding S3 of transformer T3. Winding S3 is center-tapped and this tap is directly connected to the collector of transistor Q9. The emitter of transistor Q9 is connected to temperature compensating network 17 and its base is connected to a control input, labelled FWD BIAS, from the logic circuitry. The base of transistor Q9 is also connected through pull-up resistor R10, which has a resistance of, e.g., 10 K to a bias voltage of, e.g., 18–25 VDC. The primary winding, P3, of transformer T3 is connected at one end to ground and at the other to an input, labelled AUDIO, from the voice/audio signal source of siren 1. Although diodes D1 and D2 are not necessary during audio operation, they do prevent interaction between the output transistors and primary windings P1 and P2 during operation in the siren mode.

The operation of amplifier 11 is as follows: When the system is off (i.e., when neither siren nor voice/audio output is desired), there is no signal at the AUDIO input, the voltage level at FWD BIAS (and hence on the base of transistor Q9) is a logic "1," and the voltage level at INPUT 1 and INPUT 2 is a logic "0." This logic "0,⇄ of course, appears at the bases of Darlingtons Q5 and Q7. During the off condition, therefore, the Darlingtons are reverse biased. They cannot conduct because the logic "0" is present on their bases. Likewise transistor Q9 in the voice/audio section cannot conduct because of the logic "1" at its base, and section 15 is inactive since there is no voice/audio input signal at AUDIO.

Figure 3:
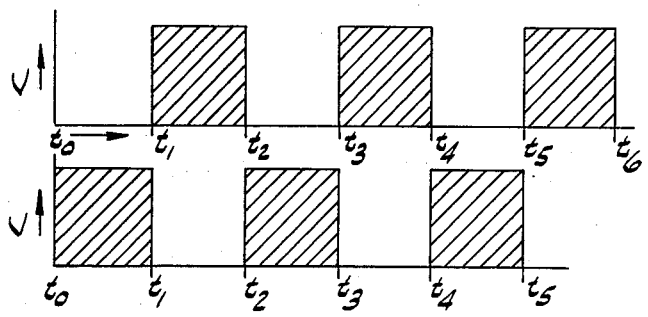
FIG. 3 is a diagram showing wave forms present in the electronic siren amplifier of the present invention and useful in explaining the operation thereof.

During operation in the siren mode, voice/audio section 15 remains inactive, since FWD BIAS stays at a logic "1" and no signal is present at AUDIO. However, throughout operation in the siren mode, the levels at INPUT 1 and INPUT 2 alternately go to a logic "1," which with the present circuit is equivalent to an open circuit, with a 50% duty cycle. As a result, the voltage waveforms shown in FIG. 3 appear at the bases of Darlingtons Q5 and Q7, the top curve representing the waveform at the base of Darlington Q5 and the bottom one representing that at the base of Darlington Q7. These waveforms are complementary square waves, each with a rise time of, e.g., 10 ns. or less and having a magnitude equal to the pull-up voltage. Because of the fast rise times involved, the leading edges of the square waves would produce voltage spikes at the load if not for the presence of capacitors C1 and C3. From a casual inspection of FIG. 3, one can see that whenever the voltage on the base of Darlington Q5 is a logic "1," the voltage on the base of Darlington Q7 is a logic "0" and vice versa.

Whenever the voltage on the base of one of the Darlington goes to a logic "1," that Darlington conducts. This causes its collector and the base of its associated output transistor (Q1 and Q3 respectively) to go to a logic "0." At the same time the voltage on the base of the other Darlington is a logic "0," and hence that Darlington does not conduct (or stops conducting), and its collector and the base of its associated output transistor goes to a logic "1." Thus, whenever the base of one of the output transistors is at a logic "0," the base of the other is at a logic "1" and vice versa. As a result, transistor Q1 conducts only when the logic level at the base of Darlington Q5 is a "1," and transistor Q3 conducts only when the logic level at the base of Darlington Q7 is a "1." Since the voltage levels on the bases of the Darlingtons are complementary, output transistors Q1 and Q3 also conduct in a complementary or push-pull manner. The Darlingtons are high current gain devices and are directly connected to the bases of their associated output transistors. Thus, whenever they conduct, which occurs only in response to the siren tone signals, they drive their associated output transistors into saturation.

When output transistor Q1 conducts, current flows from the 13.6 VDC supply, through winding section P1A and through the transistor. A portion of this current flows through the emitter/base junction of transistor Q1, through Darlington Q5 and through resistor R5 to ground, but the majority flows through the emitter/-collector circuit of transistor Q1, and through winding section P1B to ground. The total current through winding P1 is transformed by transformer T1 and supplied to speaker 13. Note that not only the emitter/collector current of transistor Q1 is used to generate useful work, by flowing through the entire primary winding P1, but also the base current is used, since it flows through winding section P1A of that primary winding. By using this base current in this manner, rather than dissipating it as heat, the heat dissipation problems normally associated with such circuits are reduced. Note also that while transistor Q1 is conducting, transistor Q3 is reverse biased hard off, because of the 18–25 VDC bias voltage applied through resistor R3 to its base, and hence no significant leakage currents flow through this transistor, which currents would, of course, also generate unwanted heat. Likewise, when output transistor Q3 conducts, its base current and emitter/collector current both flow through at least part of primary winding P2 doing useful work, and transistor Q1 is reverse biased hard off. Resistors R1 and R3 in conjunction with the bias voltage source, therefore, constitute means for reverse biasing their respective output transistors when the other output transistor is conducting. Thus, during the siren mode of operation, current alternately and efficiently flows through primary windings P1 and P2, causing corresponding output currents to flow in the secondary winding. Therefore transistors Q1 and Q3 constitute means, or first and second switching devices, which are disposed or interposed between the first and second winding sections of each primary winding for opening and closing the circuit between the winding sections of their associated primary windings in response to the signals from the siren tone generator, whereby currents corresponding to the siren tone signals flow through the primary windings causing the loudspeaker to acoustically broadcast the siren tone.

The resistance of resistor R5 and the inductance of winding sections P1A and P2A are chosen to limit the direct current and alternating current components of the base and collector currents of output transistors Q1 and Q3 at that point which produces a saturated emitter/collector junction. This in turn produces minimum transistor heating due to collector/emitter voltage drop. Likewise Darlingtons Q5 and Q7 are forward biased into saturation when on, to minimize their collector/emitter voltage drop. Winding sections P1B and P2B also serve as useful function in reducing heat generation by elevating output transistors Q1 and Q3, respectively, above ground potential, thereby allowing adequate base current for saturation of the output transistors. Of course, sections P1B and P2B also limit the collector-emitter current through output transistors Q1 and Q3.

In the audio mode of operation, amplifier 11 operates class AB. In this mode FWD BIAS goes to a logic "0," INPUT 1 and INPUT 2 are also a logic "0," and a voice/audio signal, having a substantially sinusoidal waveform is supplied to AUDIO. As a result of the logic "0" at FWD BIAS, transistor Q9 conducts, allowing current to flow through the resistor of temperature compensating network 17 and through transistor Q9 to the center tap of the secondary winding of transformer T3. Network 17 limits this current to a value which slightly forward biases diodes D1 and D3 and transistors Q11, Q13, Q1 and Q3, thereby eliminating crossover distortion in the amplifier. As the system temperature changes, network 17 causes this biasing current to change correspondingly to maintain the proper forward bias on said diodes and transistors. Therefore, network 17, transistor Q9 and transformer T3 constitute means for slightly forward biasing the output transistors when speech signals and the like are being amplified. Furthermore, network 17 and transistor Q9 constitute means for supplying a predetermined amount of direct current to the center tap of winding S3.

When a vocal/audio signal is present at AUDIO, transformer T3 matches its impedance to that of the amplifier and produces two signals, 180° out of phase, which are supplied through diodes D1 and D3 respectively to the bases of transistors Q11 and Q13. During the positive half cycle of the sinusoidal audio waveform, i.e., when current flows out of the top of winding S3 and through diode D1, transistor Q11 conducts, which causes output transistor Q1 to conduct and a corresponding current to flow through winding P1. Likewise, on the other half cycle, transistor Q13 and output transistor Q3 conduct, causing a corresponding current to flow through winding P2. Thus section 15 constitutes means for amplifying speech signals and the like and for supplying the amplified speech signals and the like to the bases of the output transistors. Accordingly, the voice/audio signal originally present at AUDIO is amplified by amplifier 11 and supplied via the secondary winding of transformer T1 to speaker 13. Resistors R11 and R13 function in this audio mode to limit the collector/emitter current flowing through transistors Q11 and Q13 and provide negative feedback.

Transformer T1 is preferably an E/I lamination transformer wound with standard techniques and having twelve turns each in winding sections P1A and P2A and three turns each in winding sections P1B and P2B. Output transistors Q1 and Q2 need not be beta-matched when used with an E/I lamination transformer. Excellent results have been achieved using 2N5883 type transistors from Motorola as the output transistors. If desired a toroidal transformer can be used as transformer T1 but in that case output transistors Q1 and Q3 must be beta-matched or some other adjustment must be made for matching. It is not necessary to use a toroidal transformer in amplifier 11, however, since efficiencies approaching or equal to those of competitive units using toroidal transformers are achievable in amplifier 11 using an E/I lamination transformer, without the added expense of beta-matched output transistors. Excellent results have also been achieved using MJE 3300 type Darlington-configured transistors for Darlingtons Q5 and Q7.

In view of the above, it will be seen that the several objects of the invention are achieved and other advantageous results attained.

As various changes could be made in the above advantageous without departing from the scope of the invention, it is intended that all matter contained in the above despcription or shown in the accompanying drawings shall be interpreted as illustrative and not in a limiting sense.

What is claimed is:

1. In an electronic siren having a siren tone signal generator for generating siren tone signals at relatively low voltage levels, an amplifier for amplifying the siren tone signals, and a loudspeaker operatively connected to the amplifier for acoustically broadcasting a siren tone corresponding to the signals generated by the signal generator, an improved amplifier comprising:

an output transformer having first and second primary windings and having a secondary winding for connection to the loudspeaker, each primary winding being connected during operation between a voltage source and ground and each including first and second winding sections; and means disposed between the first and second winding sections of each primary winding for opening and closing the circuit between the winding sections in response to the signals from the siren tone signal generator, whereby currents corresponding to the siren tone signals flow through the primary windings causing the loudspeaker to acoustically broadcast the siren tone.

2. Apparatus as set forth in claim 1 wherein the first winding section of the first primary winding has a larger number of turns than the second winding section of said first primary winding.

3. Apparatus as set forth in claim 2 wherein the first winding section of each primary winding is disposed between the voltage source and the opening and closing means and the second winding section of each primary winding is disposed between the opening and closing means and ground.

4. Apparatus as set forth in claim 2 wherein the first winding section of the second primary winding has a larger number of turns than the second winding section of said second primary winding.

5. Apparatus as set forth in claim 4 wherein the first winding section of the first primary winding has substantially the same number of turns as the first winding section of the second primary winding and the second winding section of the first primary winding has substantially the same number of turns as the second winding section of the second primary.

6. Apparatus as set forth in claim 4 wherein the first winding sections of each primary winding have at least twice the number of turns of the second winding sections of each primary winding.

7. Apparatus as set forth in claim 6 wherein the number of turns of each first winding section is approximately four times the number of turns of each second winding section.

8. Apparatus as set forth in claim 1 wherein the output transformer is an E/I lamination transformer.

9. In an electronic siren having a siren tone signal generator for generating first and second complementary siren tone signals at relatively low voltage levels, an amplifier for amplifying the siren tone signals, and a loudspeaker operatively connected to the amplifier for acoustically broadcasting a siren tone corresponding to the signals generated by the signal generator, an improved amplifier comprising:

first and second high current gain devices for amplifying the first and second complementary siren tone signals;

an output transformer having first and second primary windings and having a secondary winding for connection to the loudspeaker, each primary winding being connected during operation between a voltage source and ground and each including first and second winding sections; and first and second switching devices interposed between the first and second winding sections of the first and second primary windings respectively for opening and closing the circuit between the winding sections of their associated primary windings in response to the amplified first and second complementary siren tone signals respectively, whereby current corresponding to the siren tone signals flow through the primary windings causing the loudspeaker to acoustically broadcast the siren tone.

10. Apparatus as set forth in claim 9 wherein the switching devices are first and second output transistors, the collector/emitter circuit of each being disposed in series between the first and second winding sections of its respective primary winding.

11. Apparatus as set forth in claim 10 further including means for reverse biasing the first output transistor when the second output transistor is conducting and for reverse biasing the second output transistor when the first output transistor is conducting.

12. Apparatus as set forth in claim 10 wherein the first high current gain device is directly connected to the base of the first output transistor and the second high current gain device is directly connected to the base of the second output transistor, whereby the high current gain devices drive their associated output transistors into saturation in response to the respective siren tone signals.

13. Apparatus as set forth in claim 9 wherein the first winding sections of the first and second primary windings are disposed between the voltage source and the first and second switch devices respectively and the second winding section of the first and second primary windings are disposed between ground and the first and second switching devices respectively, said first winding sections each having more turns than said second winding sections.

14. In an electronic siren having a siren tone signal generator for generating siren tone signals at relatively low voltage levels, a voice/audio input signal source for supplying electric signals substantially equivalent to speech or the like, an amplifier for amplifying the siren tone signals and speech signals, and a loudspeaker operatively connected to the amplifier for acoustically broadcasting the siren tone or speech or the like corresponding to the amplified signals, an improved amplifier comprising:

an output transformer having first and second primary windings and having a secondary winding for connection to the loudspeaker, each primary winding being connected during operation between a voltage source and ground and each including first and second winding sections;

first and second output transistors disposed between the first and second winding sections of the first and second primary windings respectively for opening and closing the circuit between the winding sections of their associated primary windings in response to the siren tone signals; and voice/audio amplifying means for amplifying the speech signals and the like and for supplying the amplified speech signals and the like to the bases of the first and second output transistors.

15. Apparatus as set forth in claim 14 wherein the voice/audio amplifying means includes means for slightly forward biasing the output transistors when speech signals and the like are being amplified.

16. Apparatus as set forth in claim 15 wherein the forward biasing means includes a transformer with a center-tapped secondary winding and means for supplying a predetermined amount of direct current to the center tap of said secondary winding.

17. An amplifier comprising a first amplification stage, output transistors operatively connected to the first amplification stage, and an output transformer having first and second primary windings and a secondary winding for connection to a loudspeaker, said primary windings each having first and second winding sections, one of the output transistors having its collector/emitter circuit connected in series between the winding sections of the first primary winding and the other output transistor having its collector/emitter circuit connected in series between the winding sections of the second primary winding, each primary winding being connected during operation between a voltage source and ground, whereby the conducting of one of the output transistors causes current to flow in its associated primary winding.

18. Apparatus as set forth in claim 17 wherein the first winding sections are connected between the voltage source and their associated output transistors, each first winding section having a predetermined number of turns selected to limit the base-emitter and emitter-collector currents of its respective output transistor to that current which produces a saturated collector/emitter circuit with a minimal collector/emitter voltage drop, whereby heating of said transistors is minimized.

19. Apparatus as set forth in claim 17 wherein the second winding sections are connected between ground and their associated output transistors, each second winding section having a predetermined number of turns selected to elevate its output transistor above ground potential thereby allowing adequate transistor base current for saturation.

* * * * *